US005324624A

United States Patent [19]

Twist

[11] Patent Number: 5,324,624

[45] Date of Patent: Jun. 28, 1994

[54] REDOX AMPLIFICATION METHOD OF FORMING A PHOTOGRAPHIC COLOR IMAGE

[75] Inventor: Peter J. Twist, Gt. Missenden, Great Britain

[73] Assignee: Eastman Kodak Company, Rochester, N.Y.

[21] Appl. No.: 988,933

[22] PCT Filed: Jul. 7, 1992

[86] PCT No.: PCT/EP92/01526

§ 371 Date: Mar. 11, 1993

§ 102(e) Date: Mar. 11, 1993

[87] PCT Pub. No.: WO93/01524

PCT Pub. Date: Jan. 21, 1993

[30] Foreign Application Priority Data

Jul. 11, 1991 [GB] United Kingdom ..... 9114933

[51] Int. Cl.[5] ..... G03C 5/18; G03C 5/26; G03C 5/22; G03C 7/00

[52] U.S. Cl. ..... 430/399; 430/367; 430/373; 430/414; 430/421; 430/442; 430/936; 430/943

[58] Field of Search ..... 430/399, 414, 943, 373, 430/936, 367, 421, 442

[56] References Cited

U.S. PATENT DOCUMENTS

| | | | |
|---|---|---|---|
| 3,841,873 | 10/1974 | Mowrey et al. | 430/373 |
| 4,094,682 | 6/1978 | Fujiwhara et al. | 430/367 |
| 4,113,490 | 9/1978 | Fujiwhara et al. | 430/373 |
| 4,192,681 | 3/1980 | Fujiwhara et al. | 430/373 |
| 4,469,780 | 9/1984 | Hirai et al. | 430/373 |
| 5,260,184 | 11/1993 | Marsden et al. | 430/399 |

FOREIGN PATENT DOCUMENTS

| | | | |
|---|---|---|---|
| 2527398 | 1/1976 | Fed. Rep. of Germany | 430/373 |
| 61-088259 | 6/1986 | Japan . | |
| 1268126 | 3/1972 | United Kingdom . | |
| 1399481 | 7/1975 | United Kingdom . | |
| 1403418 | 8/1975 | United Kingdom . | |
| 1560572 | 2/1980 | United Kingdom . | |
| 9207299 | 4/1992 | World Int. Prop. O. . | |

*Primary Examiner*—Charles L. Bowers, Jr.
*Assistant Examiner*—J. Pasterczyk
*Attorney, Agent, or Firm*—Sarah Meeks Roberts

[57] ABSTRACT

An imagewise exposed photographic silver halide color material is treated in a first processing bath containing a developer solution comprising a color developing agent. After treatment in the first bath, the photographic material is treated in a second processing bath containing a developer/amplifier solution comprising an amplifying oxidant and the color developing agent, wherein developer solution is carried over with the photographic material from the first bath to the second bath. The second bath is replenished with developer-/amplifier replenisher solution. The first bath is replenished with developer replenisher solution in sufficient volume to cause overflow of the developer solution from the first bath, which overflow is conveyed from the first bath to the second bath. The concentration of the color developing agent in the developer/amplifier solution of the second bath is maintained at 0.1 to 20 g/l.

15 Claims, No Drawings

REDOX AMPLIFICATION METHOD OF FORMING A PHOTOGRAPHIC COLOR IMAGE

This invention relates to a method of forming a photographic colour image and specifically to such a method employing image amplification techniques.

Redox amplification processes have been described, for example in British Specification Nos. 1,268,126, 1,399,481, 1,403,418 and 1,560,572. In such processes colour materials are developed to produce a silver image (which may contain only small amounts of silver) and then treated with a redox amplifying solution (or a combined developer-amplifier) to form a dye image. The developer-amplifier solution contains a reducing agent, for example a colour developing agent, and an oxidising agent which will oxidise the colour developing agent in the presence of the silver image which acts as a catalyst. The photographic material used in such a process may be a conventional coupler-containing silver halide material or an image transfer material containing redox dye releasers. Oxidised colour developer reacts with a colour coupler (usually contained in the photographic material photographic material) to form image dye. The amount of dye formed depends on the time of treatment or the availability of colour coupler rather than the amount of silver in the image as is the case in conventional colour development processes. Examples of suitable oxidising agents include peroxy compounds including hydrogen peroxide and compounds which provide hydrogen peroxide, e.g. addition compounds of hydrogen peroxide; cobalt (III) complexes including cobalt hexaammine complexes; and periodates. Mixtures of such compounds can also be used. A particular application of this technology is in the processing of silver chloride colour paper, especially such paper with low silver levels.

In order to avoid having to use a solution which contains both colour developing agent and an oxidant (which solution is inherently unstable), it is well known that, in addition to treating the photographic material with a single developer/amplifier it is possible first to develop the silver image and later, in a separate bath, to treat with an amplifying bath to form the dye image using the previously formed silver image as a catalyst. The amount of dye in such a system is limited by the amount of colour developing agent carried over into the second bath from the first. In order to provide sufficient colour developer it would be necessary to have a level of colour developing agent in the developer bath which would be too high for continuous running.

One way of operating such a known amplification process has been proposed in Japanese Kokai 61/088259 in which, before the developer/amplification step the photogaphic material is treated in a "pre-processing liquid" which contains colour developing agent but not oxidant. In the commercial world, however, thought needs to be given to keeping the processing running in stable condition over long periods of time.

The present invention provides a process which can be operated under commercial conditions of use in, say, a minilab showing considerable advantages in a number of areas.

According to the present invention there is provided a method of forming a photographic colour image comprising processing an imagewise exposed photographic silver halide colour material in a first processing bath containing a colour developing agent (developer), a second processing bath containing an amplifying oxidant and an optional colour developer developing agent (developer/amplifier), and optionally further processing baths, said baths being replenished characterised in that the overflow from the developer bath is fed to the developer/amplifier bath.

A number of advantages accrue from the present invention:

1. The developer/amplifier can be more dilute than a single developer/amplifier could be because about 20% of the image has already been formed. This also means that the developer/amplifier solution is more stable thus leading to less time-dependant replenishment when the processing system is idle.
2. Graininess observed in strictly develop and amplify systems (no developing agent added to the amplifier bath composition) as compared to combined developer/amplifier systems, is avoided.
3. The effects of halide ion build-up in the developer-/amplifier bath which are noticeable in small volume tanks are reduced because most of the halide is produced in the first developer bath.
4. Allows the attainment of superior sensitometric results compared to a single developer/amplifier in the same processing time.
5. Allows better solution stability than a single developer/amplifier.
6. Generates less colour developing agent effluent than a single developer/amplifier.

Even if the developer/amplifier contains no colour developing agent initially, it soon will by virtue of carry-over from the first developer bath. It is usual in such circumstances to start the developer/amplifier with colour developing agent at the "seasoned solution" concentration thus keeping its concentration steady at all stages of the processing.

In the present developer baths the developing agent is preferably 4-N-ethyl-N-(β-methanesulphonamidoethyl)-o-toluidine sesquisulphate (CD3). The colour developing agent is preferably present in the developer solution in the range 0.1 to 20 g/l, preferably 1 to 10 g/l, particularly 4 to 6 g/l. Its concentration in the developer/amplifier bath is preferably in the range 0.1 to 20 g/l, preferably 0.5 to 5 g/l, particularly 1 to 3 g/l.

The concentration of oxidant, e.g. hydrogen peroxide, in the developer/amplifier bath is preferably in the range 0.1 to 60 g/l, preferably 0.3 to 9 g/l, particularly 0.9 to 4.5 g/l.

The replenishment rate for colour developing agent in the colour developer solution is preferably in the range 30 to 1500 ml/m$^2$, preferably 50 to 500 ml/m$^2$, particularly 50 to 200 ml/m$^2$ of photographic material processed. This will, in turn, produce carry-over and overflow rates of the same amount when loss by evaporation has been taken into account.

The replenishment rate for the oxidant (3% $H_2O_2$) in the developer/amplifier solution is preferably in the range 1 to 500 ml/m$^2$, preferably 5 to 100 ml/m$^2$, particularly 5 to 20 ml/m$^2$ of photographic material processed.

The processing solutions may also contain other constituents including bases, antioxidants and chelating agents, for example those mention in Research Disclosure Item 308119, December 1989 published by Kenneth Mason Publications, Emsworth, Hants, United Kingdom.

The colour photographic material to be processed may be of any type but will preferably contain low amounts of silver halide. Preferred silver halide coverages are in the range 1 to 250, preferably 50 to 150 mg/m$^2$ (as silver). The material may comprise the emulsions, sensitisers, couplers, supports, layers, additives, etc. described in Research Disclosure, December 1978, Item 17643, published by Kenneth Mason Publications Ltd, Dudley Annex, 12a North Street, Emsworth, Hants P010 7DQ, U.K.

In a preferred embodiment the photographic material comprises a resin-coated paper support and the emulsion layers comprise more than 80%, preferably more than 90% silver chloride and are more preferably composed of substantially pure silver chloride. Preferably the amplification solution contains hydrogen peroxide and a colour developing agent.

The photographic materials can be single colour materials or multicolour materials. Multicolour materials contain dye image-forming units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolour photographic material comprises a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The material can contain additional layers, such as filter layers.

The following Examples are included for a better understanding of the invention. The abbreviations DEV and DEVAMP are sometimes used to mean developer and developer/amplifier respectively..

EXAMPLE 1

The following simulated seasoned process solutions gives sensitometry close to the current standard 2001/RA-4 as shown in Table 1.

TABLE 1

| Simulated seasoned process (1) | | |
|---|---|---|
| Component | Developer | Dilute Devamp |
| (A) | 1.2 g/l | 1.0 g/l |
| (B) | 6.5 ml/l | 5.4 ml/l |
| $K_2CO_3$ | 25.0 g/l | 20.8 g/l |
| KCl | 0.43 g/l | 0.36 g/l |
| (C) | 6.0 ml/l | 5.0 ml/l |
| CD3 | 5.0 g/l | 2.0 g/l |
| $H_2O_2$ (30%) | — | 5.0 ml/l |
| pH | 10.0 | 10.0 |
| Temperature | 32° C. | |
| Time | 20 seconds | 40 seconds |

(A) is a 60% solution in water of 1-hydroxy-ethylidene-1,1-diphosphonic acid;
(B) is a 40% solution of the pentasodium salt of diethylene triamine pentaacetic acid and
(C) is an 85% solution in water of diethyl hydroxylamine.

This system is set up using the overflow and carry-over from the first developer to make the dilute Developer/Amplifier. The first developer is replenished at about 118 ml/m$^2$ and if evaporation is neglected this volume passes into the developer/amplifier. In addition peroxide is added to the developer/amplifier at 10.8 ml/m$^2$. The calculated seasoned level at equilibrium gives the developer/amplifier composition shown in Table 1.

This formula gives sensitometry equivalent to RA-4/2001 using a colour paper comprising substantially pure silver chloride emulsions and a total silver coating weight of 144 mg/m$^2$, less CD$^3$ effluent than a single developer/amplifier or RA-4/2001 process as shown by the numbers in Table 2.

TABLE 2

| CD3 input and outflow comparison | | | |
|---|---|---|---|
| | DEV-DEVAMP mg/m$^2$ | DEVAMP mg/m$^2$ | RA-4/2001 mg/m$^2$ |
| CD3 in | 688 | 995 | 1178 |
| CD3 out | 258 | 565 | 766 |

These numbers are approximate and represent only the simple outflow during running without any allowance for tank dumps. The numbers will also vary depending on the exact details of the system run but they illustrate the advantage of the DEV-DEVAMP system.

The DEVAMP formula used for the example in Table 2 is shown in Table 3 below.

TABLE 3

| Single DEVAMP formula | |
|---|---|
| Component | DEVAMP |
| (A) | 0.6 g/l |
| (B) | 2.5 ml/l |
| $K_2CO_3$ | 10.0 g/l |
| KCl | 0.35 g/l |
| (C) | 4.0 ml/l |
| CD3 | 3.5 g/l |
| $H_2O_2$ (30%) | 5.0 ml/l |
| pH | 10.3 |
| Temperature | 35° C. |
| Time | 45 seconds |

This process is replenished at 161 ml/m$^2$ and gives sensitometry equivalent to RA-4/2001.

In the single DEVAMP system it is possible to lower the concentration of CD3 and lower the replenishment rate and extend the development time to the total time in the DEV-DEVAMP system. A system like this would have the DEVAMP of the composition in Table 1 above. A comparison of the basic sensitometry and stability of the combined DEV-DEVAMP system with the same DEVAMP used by itself is in example 2.

EXAMPLE 2

In this example the sensitometry and stability of the DEV-DEVAMP system is compared with that of the DEVAMP by itself for the same total time, 60 seconds. In this test sensitometric strips were processed every hour in both the combined and the single system using the same DEVAMP solution in both cases. No replenishment was carried out. The neutral Dmax values for the DEV-DEVAMP system are shown as a function of solution age in Table 4.

TABLE 4

| System stability DEV-DEVAMP vs DEVAMP | | | | | | |
|---|---|---|---|---|---|---|
| | Neutral Dmax values | | | | | |
| | DEV-DEVAMP | | | DEVAMP | | |
| Age (hrs) | R | G | B | R | G | B |
| 0 | 277 | 271 | 243 | 277 | 265 | 217 |
| 1 | 269 | 258 | 225 | 273 | 256 | 175 |
| 2 | 266 | 250 | 218 | 267 | 245 | 155 |
| 3 | 266 | 254 | 217 | 253 | 224 | 134 |
| 4 | 251 | 232 | 212 | 248 | 220 | 133 |

TABLE 4-continued

| System stability DEV-DEVAMP vs DEVAMP | | | | | | |
|---|---|---|---|---|---|---|
| | Neutral Dmax values | | | | | |
| | DEV-DEVAMP | | | DEVAMP | | |
| Age (hrs) | R | G | B | R | G | B |
| 5 | 247 | 233 | 204 | 232 | 200 | 131 |
| 6 | 238 | 227 | 204 | 224 | 195 | 117 |
| 7 | 227 | 218 | 204 | 198 | 170 | 104 |

This test shows that for the same total development time the initial sensitometry of the DEV-DEVAMP system is superior to the DEVAMP used by itself; this can be seen in the blue record. In addition the DEV-DEVAMP system maintains its activity better than the single DEVAMP as the solutions age. This means that the DEV-DEVAMP system is better in at least three ways:

1. It has better initial sensitometry.
2. It is more stable.
3. It is a viable system which produces low levels of CD3 in the effluent.

It is possible to produce even lower CD3 effluent. Table 5 shows this relation for compositions designed to give acceptable sensitometry similar to that in Table 1 of Example 1 for the same total development time. It is noted, however, that if processing times are lengthened there are many more possible combinations available.

TABLE 5

| DEV-DEVAMP composition and CD3 discharge | | | | |
|---|---|---|---|---|
| CD3 g/l | | Replenishment rate ml/m$^2$ | | |
| DEV | DEVAMP | DEV-REP | $H_2O_2$REP | CD3 out mg/m$^2$ |
| 8 | 1.3 | 54 | 11 | 84 |
| 7 | 1.5 | 66 | 11 | 115 |
| 6 | 1.8 | 87 | 11 | 179 |
| 5 | 2.0 | 118 | 11 | 258 |
| 4 | 2.2 | 204 | 11 | 473 |

Although the data in Table 4 suggest that the best system to use would be that with the most CD3 in the developer, i.e., the 8 g/l case or even higher, some other factors need to be considered. It becomes more difficult to replenish the developer the more concentrated it is and kit concentrates might need to be used. Secondly, from work on the original version of split development high CD3 levels in the first developer can generate increased grain and colour contamination due to the high amplification rate in the first 10 seconds after entering the DEVAMP. This can be moderated to some extent by adjusting the chloride level but 8 g/l CD3 is probably the upper limit.

As the level of CD3 in the developer is increased a lower level of CD3 in the DEVAMP can be used to give acceptable sensitometry. This means that the volume of developer replenisher can be lowered (and made more concentrated) resulting in lower overflow from the DEVAMP. In Example 2 the case with CD3 5 g/l DEV and 2.0 g/l DEVAMP was examined. In Example 3 the case with CD3 7 g/l DEV and 1.5 g/l DEVAMP with process times a. 20 sec DEV, 40 sec DEVAMP is compared with the DEVAMP by itself for b. 60 sec.

EXAMPLE 3

Strips were processed every hour as in Example 2 using the same DEVAMP solution for both processes; no replenishment was carried out.

TABLE 6

| Simulated seasoned process | | | |
|---|---|---|---|
| | Component | DEVELOPER | DILUTE DEVAMP |
| | (A) | 1.2 g/l | 1.0 g/l |
| | (B) | 6.5 ml/l | 5.4 ml.l |
| | $K_2CO_3$ | 25.0 g/l | 20.8 g/l |
| | KCl | 0.43 g/l | 0.36 g/l |
| | (C) | 6.0 ml/l | 5.0 ml/l |
| | CD3 | 7.0 g/l | 1.5 g/l |
| | $H_2O_2$ (30%) | — | 5.0 ml/l |
| | pH | 10.0 | 10.0 |
| | Temperature | 32° C. | |
| a. | Time | 20 seconds | 40 seconds |
| b. | Time | 0 | 60 seconds |

The results of this comparison are shown in table 7.

TABLE 7

| System stability DEV-DEVAMP vs DEVAMP | | | | | | |
|---|---|---|---|---|---|---|
| | Neutral Dmax values | | | | | |
| | DEV-DEVAMP | | | DEVAMP | | |
| Age (hrs) | R | G | B | R | G | B |
| 0 | 281 | 261 | 233 | 273 | 249 | 140 |
| 1 | 270 | 255 | 222 | 274 | 226 | 118 |
| 2 | 275 | 237 | 209 | 266 | 196 | 106 |
| 3 | 253 | 220 | 205 | 231 | 146 | 085 |
| 4 | 253 | 210 | 203 | 199 | 125 | 076 |
| 5 | 231 | 207 | 206 | 192 | 115 | 071 |
| 6 | 234 | 202 | 206 | 171 | 100 | 064 |
| 7 | 221 | 194 | 201 | 139 | 082 | 055 |

It can be seen from this table that the DEV-DEVAMP system has better initial sensitometry and that it is more stable on standing than the DEVAMP by itself for the same total time. In this example the difference between the two systems is more pronounced than that in Example 2. This shows that as the CD3 level in the DEVAMP is decreased the DEV-DEVAMP system is increasingly superior to the single DEVAMP system.

I claim:

1. A method of forming a photographic color image, comprising:

treating an imagewise exposed photographic silver halide color material in a first processing bath containing a developer solution comprising a color developing agent, treating said photographic material after treatment in said first bath, in a second processing bath containing a developer/amplifier solution comprising an amplifying oxidant and said color developing agent, wherein said developer solution is carried over with said photographic material from said first bath to said second bath, replenishing said second bath with developer/amplifier replenisher solution, replenishing said first bath with developer replenisher solution in sufficient volume to cause overflow of said developer solution from said first bath, conveying said overflow from said first bath to said second bath, and maintaining a concentration of said color developing agent in said developer/amplifier solution of said second bath at 0.1 to 20 g/l.

2. A method as claimed in claim 1, wherein said amplifying oxidant is hydrogen peroxide or a compound that provides hydrogen peroxide.

3. A method as claimed in claim 1, wherein said color developing agent is 4-N-ethyl-N-(β-methanesulphonamidoethyl)-o-toluidine sesquisulphate.

4. A method as claimed in claim 1, wherein said color developing agent is present in said developer solution at a concentration of from 0.1 to 20 g/l.

5. A method as claimed in claim 4, wherein said color developing agent is present in said developer solution at a concentration of from 1 to 10 g/l.

6. A method as claimed in claim 4, wherein said color developing agent is present in said developer solution at a concentration of from 4 to 6 g/l.

7. A method as claimed in claim 1, wherein said color developing agent is present in said developer/amplifier solution at a concentration of from 0.5 to 5 g/l.

8. A method as claimed in claim 7, wherein said color developing agent is present in said developer/amplifier solution at a concentration of from 1 to 3 g/l.

9. A method as claimed in claim 1, wherein said amplifying oxidant is hydrogen peroxide and said hydrogen peroxide is present in said developer/amplifier solution at a concentration of from 0.1 to 60 g/l.

10. A method as claimed in claim 9, wherein said amplifying oxidant is hydrogen peroxide and said hydrogen peroxide is present in said developer/amplifier solution at a concentration of from 0.3 to 9 g/l.

11. A method as claimed in claim 9, wherein said hydrogen peroxide is present in said developer/amplifier solution at a concentration of from 0.9 to 4.5 g/l.

12. A method as claimed in claim 1, wherein said replenishing of said first bath is carried out at a rate of 30 to 1500 ml/m$^2$.

13. A method as claimed in claim 12, wherein said replenishing of said first bath is carried out at a rate of 50 to 500 ml/m$^2$.

14. A method as claimed in claim 12, wherein said replenishing of said first bath is carried out at a rate of 50 to 200 ml/m$^2$.

15. A method as claimed in claim 1, further comprising:

treating said photographic material in further processing baths following said treating of said photographic material in said second bath.

* * * * *